United States Patent [19]

Flaherty

[11] Patent Number: 4,607,191

[45] Date of Patent: Aug. 19, 1986

[54] PROTECTION FILM FOR IMPROVED PHOSPHOR MAINTENANCE AND INCREASED TIME-INTEGRATED LIGHT OUTPUT

[75] Inventor: John M. Flaherty, Danvers, Mass.

[73] Assignee: GTE Products Corporation, Stamford, Conn.

[21] Appl. No.: 671,131

[22] Filed: Nov. 13, 1984

[51] Int. Cl.[4] ..... H01J 61/35

[52] U.S. Cl. ..... 313/489; 313/486

[58] Field of Search ..... 313/486, 489, 112

[56] References Cited

U.S. PATENT DOCUMENTS 3,430,089 2/1969 Sarver et al. ..... 313/486

4,459,507 7/1984 Flaherty ..... 313/486 X

FOREIGN PATENT DOCUMENTS 112064 9/1981 Japan ..... 313/486

*Primary Examiner*—David K. Moore

*Assistant Examiner*—K. Wilder

*Attorney, Agent, or Firm*—Carlo S. Bessone

[57] ABSTRACT

In a fluorescent lamp having a phosphor coating, a maintenance improving and light output increasing film comprising yttrium oxide and at least one U.V. absorber is applied over the phosphor. The U.V. absorber is effective in the absorption of a greater amount of 185 nm radiation than 254 nm radiation from the plasma discharge. The film is most beneficial when applied over alkaline earth halophosphate phosphors at a film thickness of from about 50 angstroms to about 500 angstroms.

5 Claims, 3 Drawing Figures

PROTECTION FILM FOR IMPROVED PHOSPHOR MAINTENANCE AND INCREASED TIME-INTEGRATED LIGHT OUTPUT

CROSS-REFERENCE TO RELATED APPLICATIONS

This application discloses, but does not claim, inventions which are claimed in U.S. Ser. No. 671,133 filed concurrently herewith, and assigned to the Assignee of this Application.

TECHNICAL FIELD

This invention relates to fluorescent lamps and more particularly to such lamps having an improved lamp maintenance and an increased total integrated light output over time.

BACKGROUND ART

Fluorescent lamps are well known light sources famous for their high light output and relatively long life. Such lamps comprise a tubular, hermetically sealed, glass envelope having electrodes sealed in the ends thereof. An arc generating and sustaining medium, usually at low pressure, and comprising one or more inert gases such as argon, krypton, etc., or mixtures thereof, together with a small amount of mercury, is present in the envelope. The interior of the envelope is coated with a layer of phosphor which will absorb various forms of energy generated by the arc (usually wavelengths of ultraviolet) and reemit this energy in the form of visible light.

Those lamps, as well as all other known lamps, suffer from a gradual decrease in light output as they age. The light output of a lamp at any time is given as a fraction or a percentage of the original output and is called the maintenance at that time. Maintenance can be measured in lumens or other arbitrary units. Poor maintenance has been a major factor preventing the successful application of many phosphors.

The conditions that cause the loss in light output are many and include the initial processing conditions where the lamp is baked to temperatures of 600° C. which can cause serious degradation in the performance of some phosphors.

After completion of the lamp, during operation thereof, the phosphor is subjected to the mercury vapor discharge where it is bombarded by ions as well as being exposed to high energy ultraviolet 185 nm and 254 nm radiation. Studies have shown that the 185 nm radiation is considerably more detrimental to alkaline earth halophosphate phosphors than the 254 nm radiation.

A number of techniques have been suggested to overcome or at least retard the decrease in loss of light output. These techniques have included better processing of the phosphors, and methods to shield the phosphors from the deleterious effects of the lamp processing and arc discharge by the application of a protective film over the phosphor. Various materials for this shielding have included non-continuous particulate films of, for instance, silica and alumina.

One technique to improved maintenance is described in U.S. Pat. No. 4,459,507, dated July 10, 1984 issued to J. M. Flaherty and assigned to the Assignee of the present application. This patent involves applying a nonluminescent maintenance improving film of yttrium oxide overlying the phosphor. This film protects the phosphor from ion bombardment but not from the deleterious effects caused by the 185 nm radiation.

While all of the above techniques have provided an improvement in the maintenance, it would be an advance in the art to further improve maintenance as well as increase the total integrated light output of fluorescent lamps.

DISCLOSURE OF THE INVENTION

It is, therefore, an object of the invention to obviate the disadvantages of the prior art.

It is another object of the invention to further improve the maintenance of fluorescent lamps.

It is still another object of the invention to increase the total integrated light output over time of fluorescent lamps.

These objects are accomplished, in one aspect of the invention, by the provision, within a fluorescent lamp, of a film comprising yttrium oxide and at least one U.V. absorber which overlies the phosphor. The absorber is effective in the absorption of a greater amount of 185 nm radiation than 254 nm radiation from the plasma discharge.

The protective film is deposited by electron beam vaporization of a target comprising yttrium oxide and at least one U.V. absorber. The vapor generated is subsequently deposited as a film upon the phosphor.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
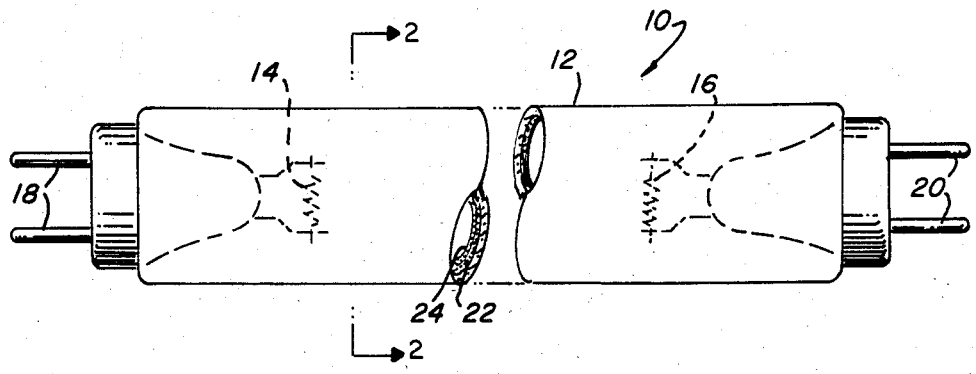
FIG. 1 is a diagrammatic elevational view of a lamp.

Referring now to the drawings with greater particularity, there is shown in FIG. 1 a fluorescent lamp 10 comprising a tubular, hermetically sealed, glass envelope 12. Electrodes 14 and 16 are sealed in the ends of envelope 12. Suitable terminals 18 and 20 are connected to the electrodes 14 and 16 and project from envelope 12. An arc generating and sustaining medium such as one or more inert gases and mercury vapor is included within envelope 12 for producing a plasma discharge when a predetermined voltage is applied across the electrodes 14 and 16.

A layer of phosphor 22 is applied to the inside surface of envelope 12. While phosphor 22 can be any material useful in fluorescent lamps, the invention herein described is particularly efficacious when the phosphor is an alkaline earth halophosphate phosphor.

Figure 2:
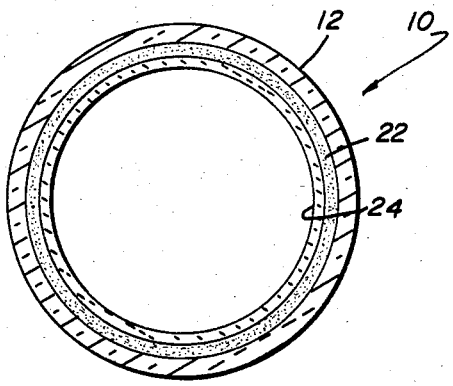
FIG. 2 is a sectional view taken along the line 2—2 of FIG. 1.

To rectify the above problems, a film 24 shown in FIG. 2 comprising yttrium oxide and at least one U.V. absorber is applied over phosphor 22. A U.V. absorber is an element which absorbs ultraviolet radiation at selected wavelengths. The U.V. absorbers in the invention are effective in the absorption of a greater amount of 185 nm radiation than 254 nm radiation from the plasma discharge. Examples of these preferred U.V.

absorbers include (but are not limited to) europium and manganese.

It has been discovered that this protective film 24, which takes the form of a continuous, non-particulate film, performs a maintenance function as well as provide an increase in the total integrated light output of the lamp throughout its life. The thickness of film 24 should be within a range of from about 50 angstroms to about 500 angstroms. The film 24 is deposited upon phosphor 22 to the desired thickness by electron beam vaporization of a target consisting of yttrium oxide and at least one U.V. absorber. The vapor generated is subsequently deposited as film 24 on phoshor 22.

As one particular example, tests were accomplished by coating microscope slides with calcium halophosphate phosphor (i.e., Cool White) by conventional slurry techniques. The slides were then baked in air for approximately seven minutes at 550° C. One half of the phosphor carrying slides was then coated with europium activated yttrium oxide ($Y_2O_3$:Eu) of varying thickness by electron beam bombardment of an europium activated yttrium oxide target. The europium in this case being the U.V. absorber.

The slides were then inserted and sealed into 4 ft. T12lamps (40 watt). The lamps were then operated and the brightness of the coated (i.e., with $Y_2O_3$:Eu protective film) and uncoated phosphor was monitored with time using a brightness spotmeter.

Figure 3:
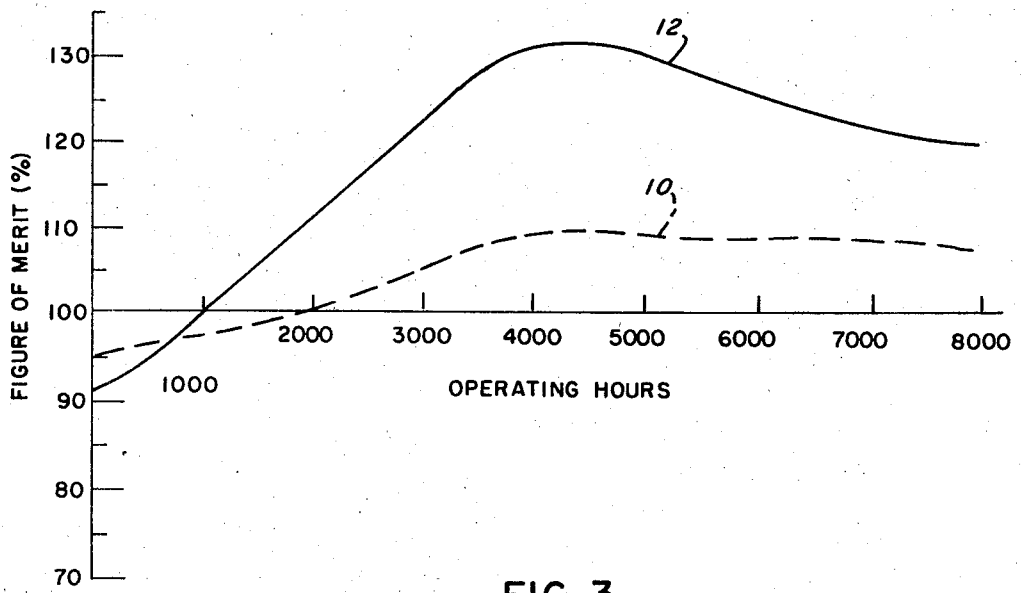
FIG. 3 shows graphically the time dependence of the relative maintenance achieved by utilization of the invention.

FIG. 3 illustrates the improvement derived by employment of the invention. The graph plots data obtained with thicknesses of the $Y_2O_3$:Eu film equal to about 120 angstroms and about 240 angstroms as tested in the aforementioned lamp size. The curves of FIG. 3 are plotted on the basis of "operating hours" as abscissa and "figure of merit" as ordinate. Dotted line curve 10 and solid line curve 12 represents a film thickness of approximately 120 angstroms and 240 angstroms, respectively.

The "Figure of Merit" (FOM) is the ratio of the brightness between coated and uncoated phosphor and is computed as $$FOM = \frac{\text{coated brightness}}{\text{uncoated brightness}} \times 100\%$$

The upward trend in curves 10 and 12 shows that the maintenance of the phosphor coated with the protective film is superior to the unprotected phosphor which is an intent of the film overcoat.

This upward trend in the FOM relates to lesser deterioration or improved maintenance due to the film presence and can be quantified, here, by expressing the ratio of the FOM at 8000 hrs. to that at 0 hrs. i.e., $$\text{MAINTENANCE} = \frac{FOM \text{ @ 8000 hrs.}}{FOM \text{ @ 0 hrs.}}$$

Clearly, the larger the above ratio, the greater will be the maintenance attributed to the film coating. The maintenance, defined above, when utilizing $Y_2O_3$:Eu films was found in a variety of lamps, to be greater than the maintenance when utilizing just $Y_2O_3$ films by 15% i.e., $$\frac{\text{MAINTENANCE WITH } Y_2O_3\text{:Eu}}{\text{MAINTENANCE WITH } Y_2O_3} = 1.15$$

This shows that with the use of a UV absorber, ie., Eu, incorporated into the protective film, further improvement of the $Y_2O_3$ protective film can be attained which is an intent of the invention.

The area above the 100 percent line in FIG. 3 enclosed by curves 10 and 12 is greater than the area enclosed below the line. This implies that the total integrated light output over lamp life from the protected phosphor is greater than that of the unprotected phosphor. This result is another intent of the invention.

As shown in FIG. 3, the lamps were operated to 8000 hours. The zero hour brightness is initially diminished by the presence of the protection film, more or less in proportion to the film thickness, i.e., 5% and 8% brightness reduction for the 120 angstrom and 240 angstrom film thicknesses respectively. Surprisingly, during operation the phosphor coated with the $Y_2O_3$:Eu experienced a lesser average rate of brightness decrease than the unprotected phosphor to the extend that the protected phosphor became brighter than the unprotected phosphor at 2000 hours and 1000 hours for the 120 angstrom and 240 angstrom film, respectively.

While there have been shown what are at present considered to be the preferred embodiments of the invention, it will be apparent to those skilled in the art that various changes and modifications can be made herein without departing from the scope of the invention as defined by the appended claims.

I claim:

1. A fluorescent lamp having improved maintenance and integrated light output comprising:

a tubular, hermetically sealed, glass envelope;

electrodes sealed in the ends of said envelope;

an arc generating and sustaining medium including mercury within said envelope for producing a plasma discharge when a predetermined voltage is applied across said electrodes;

a phosphor coating adhering to the interior surface of said envelope; and a non-particulate film overlying said phosphor wherein said film comprises yttrium oxide and at least one U.V. absorber, said absorber being effective in the absorption of a greater amount of 185 nm radiation than 254 nm radiation from said plasma discharge.

2. The lamp of claim 1 wherein said phosphor is an alkaline earth halophosphate phosphor.

3. The lamp of claim 1 wherein said film has a thickness of from about 50 angstroms to about 500 angstroms.

4. The lamp of claim 1 wherein said U.V. absorber comprises europium.

5. The lamp of claim 1 wherein said U.V. absorber comprises manganese.

* * * * *